US007369463B1

(12) United States Patent
Van Dullemen et al.

(10) Patent No.: US 7,369,463 B1
(45) Date of Patent: May 6, 2008

(54) ELECTRONIC ALARM TIMER FOR USE WITH A MEDICAL REGIMEN

(75) Inventors: Marlies Van Dullemen, EN Leiden (NL); Jan Willem Bouwknegt, HS Rozenburg (NL)

(73) Assignee: N.V. Organon (NL)

( * ) Notice: Subject to any disclaimer, the term of this patent is extended or adjusted under 35 U.S.C. 154(b) by 0 days.

(21) Appl. No.: 10/203,196

(22) PCT Filed: Feb. 19, 2000

(86) PCT No.: PCT/NL01/00147

§ 371 (c)(1),
(2), (4) Date: Aug. 5, 2002

(87) PCT Pub. No.: WO01/64161

PCT Pub. Date: Sep. 7, 2001

(30) Foreign Application Priority Data

Feb. 21, 2000 (NL) ..... 1014438

(51) Int. Cl.
*G04B 23/02* (2006.01)

(52) U.S. Cl. ..... 368/73; 368/10; 368/23

(58) Field of Classification Search ..... 368/23, 368/29, 30, 90, 93, 10
See application file for complete search history.

(56) References Cited

U.S. PATENT DOCUMENTS

| | | | | |
|---|---|---|---|---|
| 4,926,572 | A | 5/1990 | Holmes | 40/448 |
| 5,020,037 | A | 5/1991 | Raven | |
| 5,719,780 | A * | 2/1998 | Holmes et al. | 700/231 |
| 5,802,014 | A * | 9/1998 | Danko | 368/10 |
| 5,989,581 | A | 11/1999 | Groenewegen | 424/433 |
| 6,022,323 | A * | 2/2000 | Jackson | 600/551 |
| 6,075,755 | A | 6/2000 | Zarchan | 368/10 |
| 6,102,855 | A | 8/2000 | Kehr et al. | 600/300 |
| 6,314,384 | B1 * | 11/2001 | Goetz | 702/177 |
| 6,600,696 | B1 * | 7/2003 | Lynn | 368/23 |
| 6,671,456 | B2 | 12/2003 | Nishi et al. | |
| 2002/0002558 | A1 * | 1/2002 | Krause | 707/104.1 |

FOREIGN PATENT DOCUMENTS

| | | |
|---|---|---|
| FR | 2620617 | 3/1989 |
| FR | 2703906 | 10/1994 |
| FR | 2746300 | 9/1997 |

(Continued)

*Primary Examiner*—P. Austin Bradley
*Assistant Examiner*—Thanh S Phan
(74) *Attorney, Agent, or Firm*—St. Onge Steward Johnston & Reens LLC

(57) ABSTRACT

A timer for assisting in the control of various medical regimen is described. The timer is particularly adapted for use in avoiding or assuring conception by providing a graphic representation on the timer to alert a user as to when a medically correct step needs to be taken. The timer is provided with an alarm that alerts one as to when a transition from one particular part of, for example, a contraceptive regimen to another part of the regimen is about to occur and illustrates the transition on the graphic representation. A status of the regimen is also presented to a user. One graphic representation involves an hour-glass filled with granules corresponding in number to the amount of time left before a transition in the medical regimen is to occur.

20 Claims, 5 Drawing Sheets

FOREIGN PATENT DOCUMENTS

Figure 1:
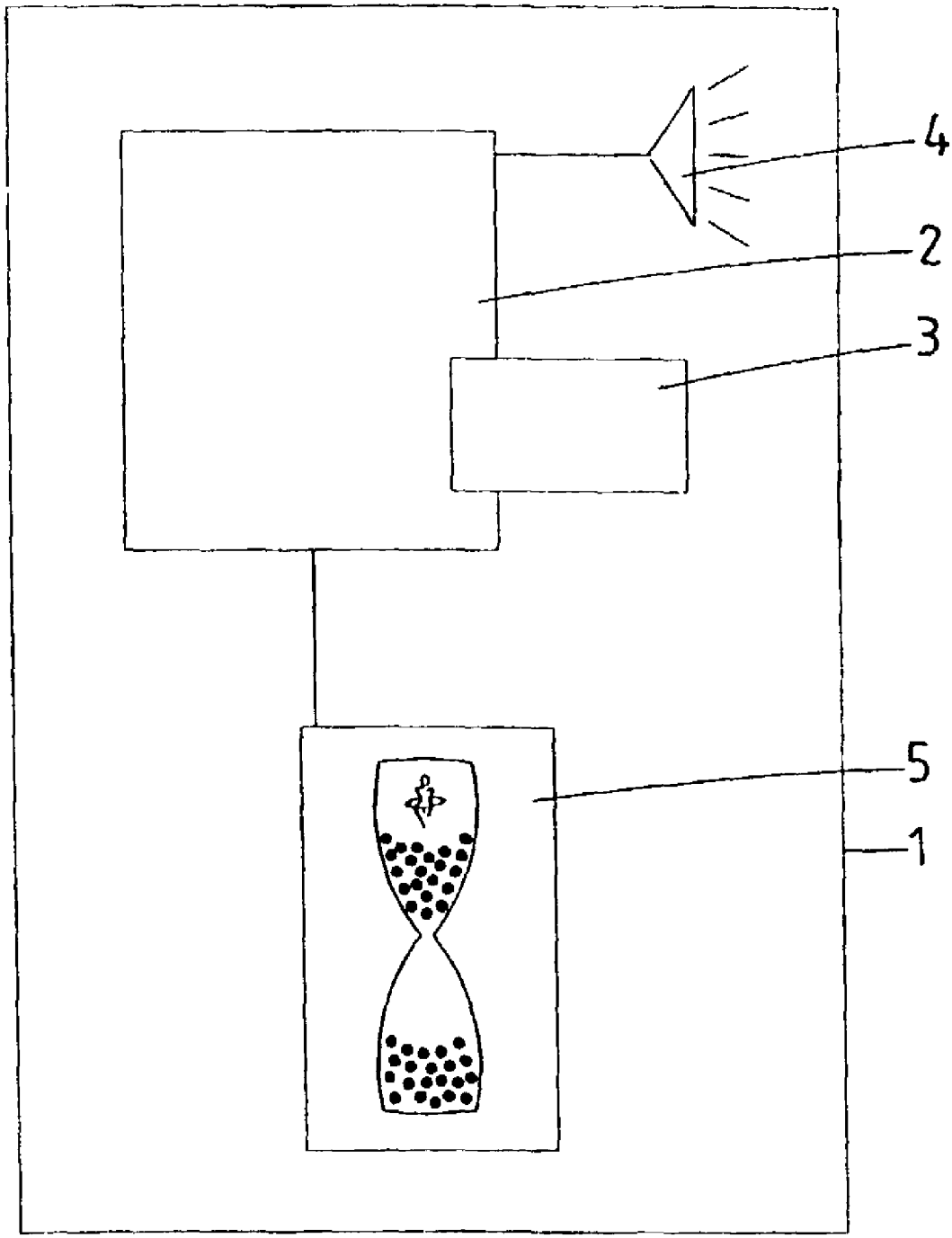

| | | | |
|---|---|---|---|
| FR | 2746300 | A1 * | 9/1997 |
| GB | 2307314 | | 5/1997 |
| RU | 1772800 | | 10/1992 |
| WO | WO 92/11587 | | 7/1992 |
| WO | WO 95/05143 | | 2/1995 |

* cited by examiner

ELECTRONIC ALARM TIMER FOR USE WITH A MEDICAL REGIMEN

The present invention relates to an electronic alarm timer for use with a medical regimen, in particular for a contraceptive, comprising a housing containing a control unit control unit having a timer, indicating means on the housing, which are connected to the control unit in order to show information, and timed alarm means connected to the control unit.

Several timers and the like, to be used as aids for reminding a person to perform a particular act on time, for example take a medicine or the like, are well-known in the art. Electronic timers to be used as aids in connection with the taking of contraceptives are known, for example, from FR-U-2 620 617 and FR-A-2 703 906. The indicating means may consist of a display showing the date and the time, whereas the alarm means consist of an audio signal. Another aid used in connection with the taking of medicines is known from EP-B-0 563 100, FR-A-2 746 300 and WO 95/05143, for example.

The object of the invention is to provide an improved electronic timer.

In order to accomplish that objective, the electronic timer according to the invention is characterized in that said control unit and said indicating means are adapted to show information on the status of the medical regimen.

By showing the information on the status of the regimen, the user is given a better insight into the regimen, which might in general make it easier to follow the regimen and/or have a positive effect on the user's behaviour. In addition, it makes it easier to check whether or not the act has been performed. In the case of pills, a display may for example show the desired situation, which pills may or may not have been taken out, which can be done without using text.

If the timer is used with a medical regimen for which various acts need to be performed, it is advantageous if the control unit and the indicating means are adapted to show information about the act to be performed.

The timer according to the invention is intended especially, but not exclusively, for use with an anti-conception regimen, wherein the indicating means, in accordance with the invention, graphically represent the days of the cycle, for example by showing a number or balls, dots or the like corresponding to the remaining number of days of the cycle.

The timer according to the invention is very advantageous 10 for use in an anti-conception regimen, wherein the contraceptive must be present in or on the body during part of the cycle and wherein the contraceptive must be removed for the duration of the other part of the cycle.

With such an anti-conception regimen there is the additional difficulty that the required acts only need to be performed twice during the four-week cycle, so that it is difficult to form a habit or routine. In addition to that, several acts need to be performed, so that the mere use of an acoustic alarm will not suffice.

The timer according to the invention provides additional assistance with regard to following such a regimen in that the indicating means graphically show the situation, whereas the alarm is adapted to sound at the time of the transition from one part of the cycle to another, whereby the various acts, such as the removal or the insertion/application, as the case may be, of the contraceptive is indicated by means of an animation on the display.

The status that is shown on the indicating means (the presence or absence of the contraceptive) represents the desired situation in accordance with the programmed cycle.

The user herself can check whether the actual situation indeed accords with the desired situation. Since the user herself is not required to input anything or set the timer, the risk of operating errors is ruled out. This makes the timer highly reliable. Owing to the graphic representation of the desired status and of the acts to be performed, the timer will be easy to understand all over the world without any (linguistic) adaptations being required. The timer will thus remind the user of the acts to be performed, therefore helping the user to comply with the regimen in a reliable manner.

The invention will now be explained in more detail with reference to the drawings, which very schematically show a few embodiments of the electronic timer according to the invention.

FIG. 1 is a very schematic representation of the electronic timer according to the invention.

FIGS. 2*a*-2*k* show the display of the timer of FIG. 1 at various points in time during the cycle of the medical regimen.

Figure 2:
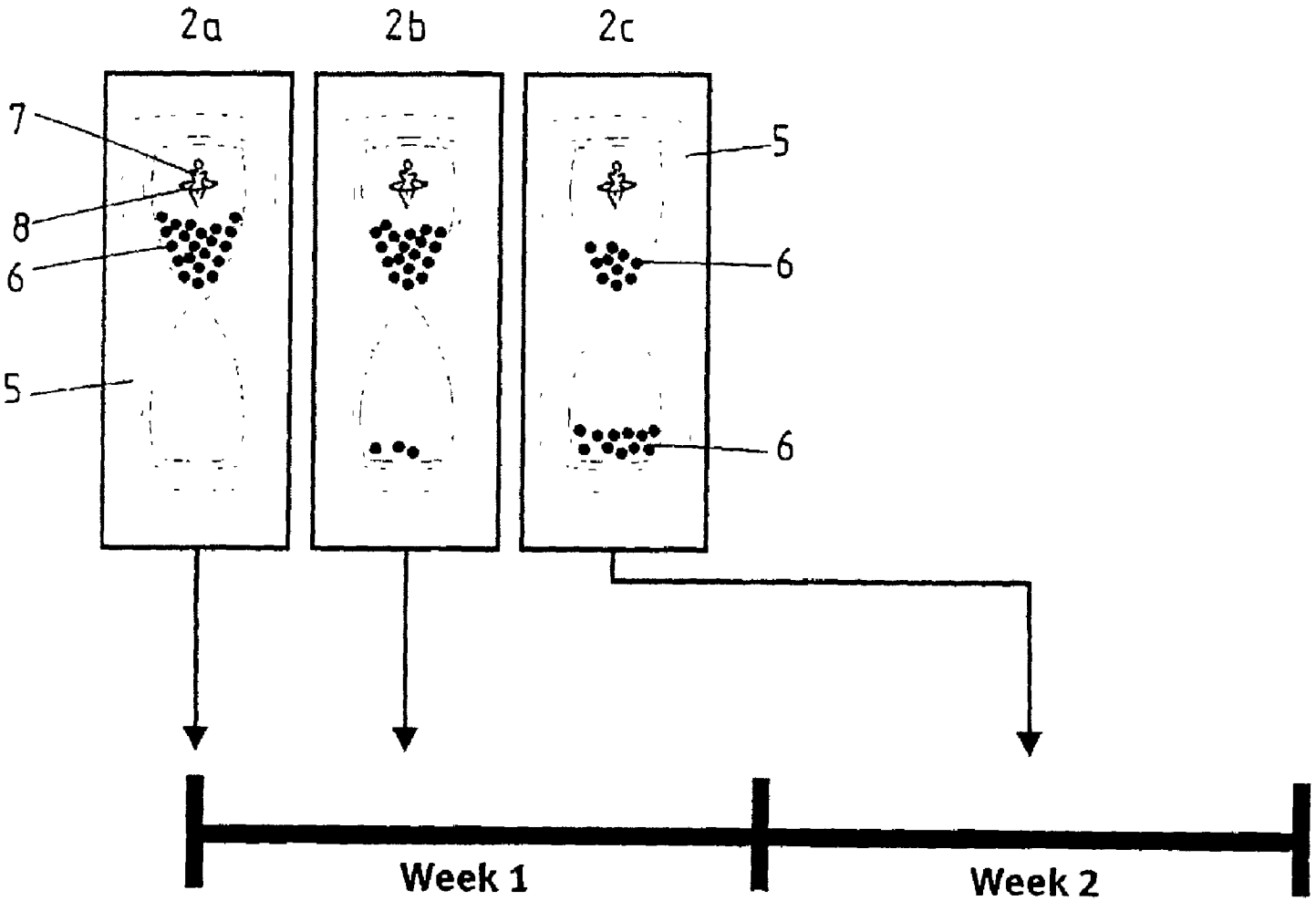
Figure 2:
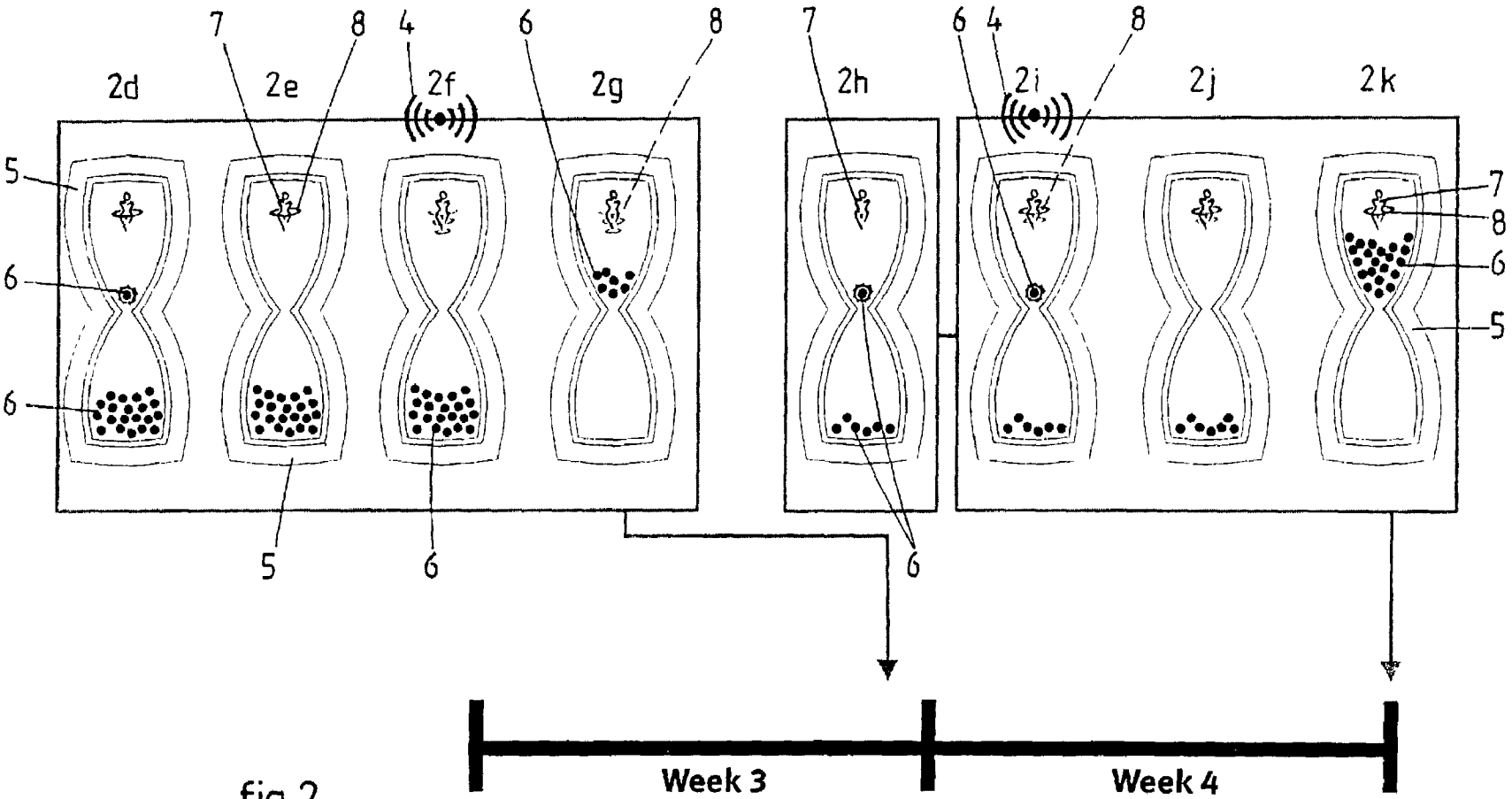
Figure 3:
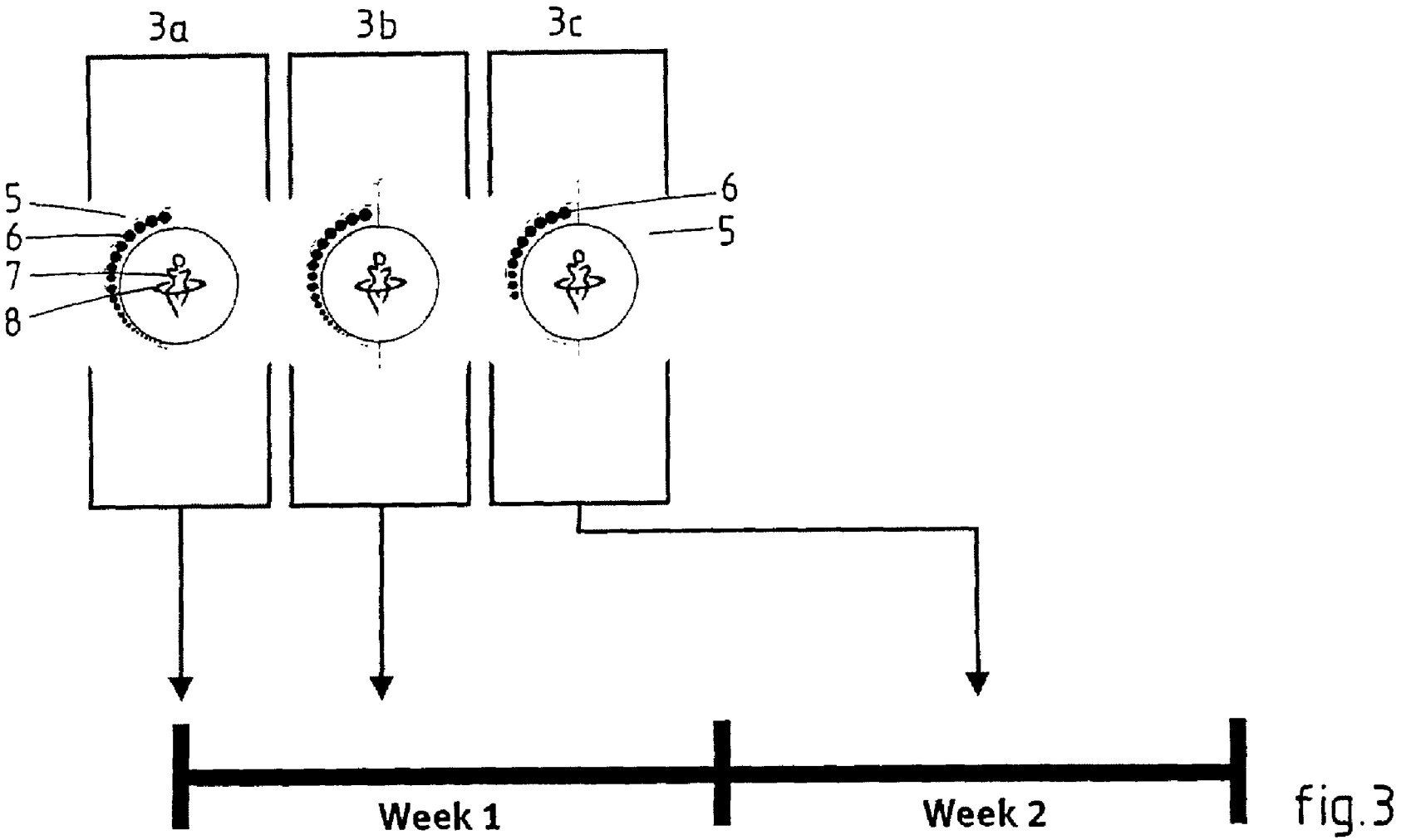
Figure 3:
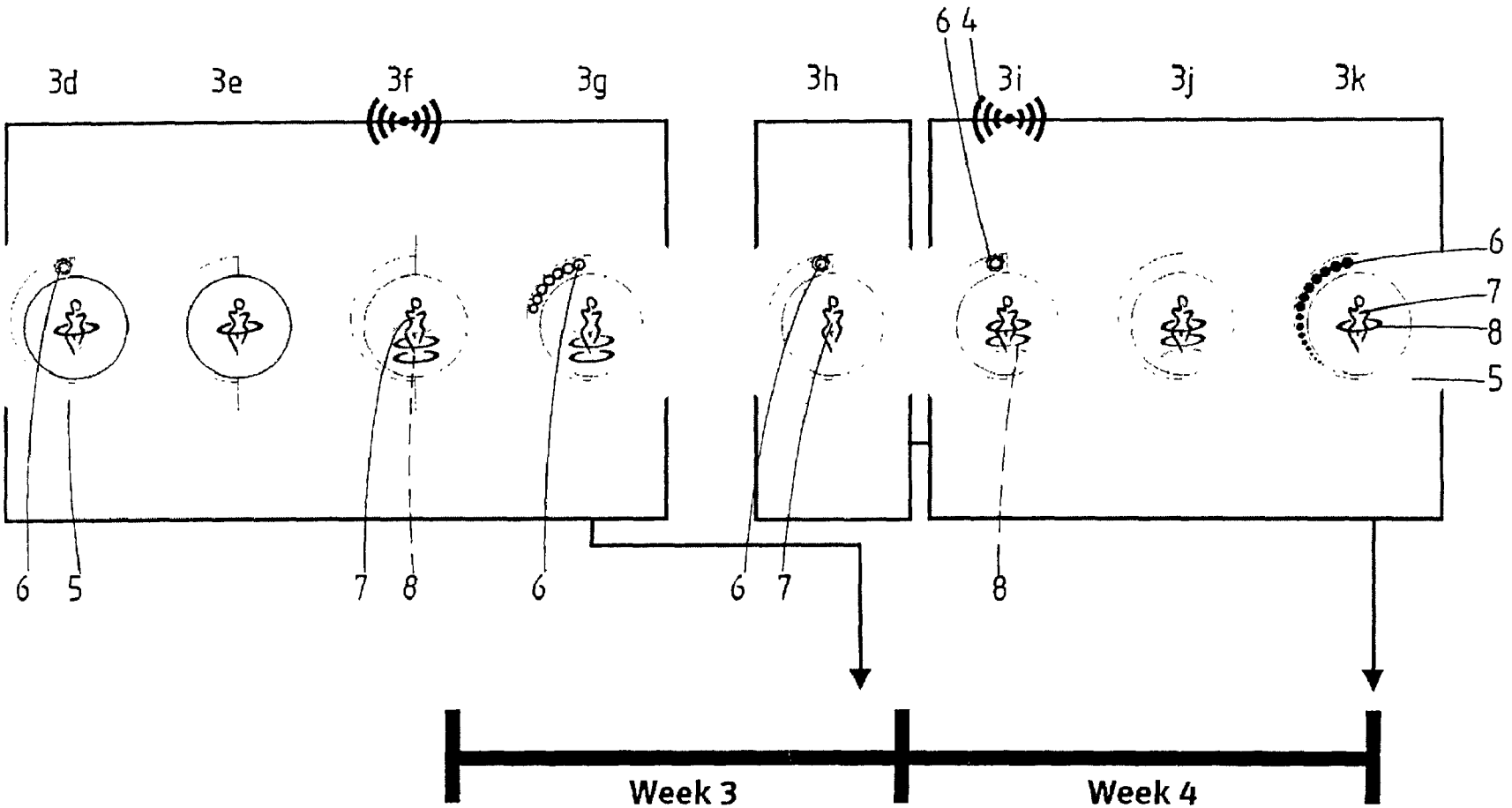

FIGS. 3*a*-3*k* are views corresponding to FIG. 2 of a second embodiment of the display of the timer according to the invention.

FIG. 1 schematically shows the components of the embodiment of the electronic timer according to the invention, which comprises a housing 1 having the desired shape, in which a number of components are accommodated. The heart of the timer consists of a control unit 2, which may, for example, comprise a microprocessor or a custom-made IC or the like. An electronic timer 3 is connected to the control unit or integrated therein, whereas also an alarm means, such as an acoustic signalling element 4 or the like is connected to the control unit or integrated therein. Present on the outside of housing 1, or at least visible from the outside, is an indicating means, in particular an electronic display 5. Control unit 2 and display 5 are adapted to show information on the status of the medical regimen.

In the present embodiment, the timer has been designed as a useful aid for use with an anti-conception regimen, wherein the user is reminded of specific acts that have to be performed at predetermined points in time. In the illustrated example, a special kind of anti-conception regimen is used, wherein no pills are to be taken but wherein a carrier containing a contraceptive is to be inserted into the vagina (see for example U.S. Pat. No. 5,989,581, whose contents are incorporated herein by this reference) or applied to the body in the form of a plaster. With such a regimen, the carrier gives off the contraceptive to the body in a controlled manner during the period it remains in or on the body. In the artificially induced 4-week cycle this means that the carrier needs to remain inside the body for three weeks, after which it must be removed. One week after said removal, a new carrier containing a contraceptive must be inserted. This implies that two different acts need to be performed during a cycle, viz. the insertion and the removal of the contraceptive. The control unit 2 and the display 5 of the electronic timer are adapted to show the point in time at which an act is to be performed and at which the alarm will sound as well as the type of act that is to be performed. Furthermore, the status or the progress of the cycle is graphically is shown continuously.

FIGS. 2*a*-2*k* show the display 5 of the electronic timer of FIG. 1 at various points in time during the cycle.

FIG. 2*a* shows the display 5 at the beginning of the cycle. The display shows an hourglass or has the shape of an hourglass, and the "grains" 6 in the hourglass each represent one day of the first (three-week) part of the cycle. At the beginning of the cycle, all grains 6 are present in the upper part of the hourglass. Display 5 furthermore shows a female 7, who is surrounded by a ring 8 representing the carrier of the contraceptive (for example a ring of a soft plastic material which gives off hormones when worn in a woman's vagina). Said ring 8 indicates that the carrier of the contraceptive must remain inserted during the aforesaid three weeks. FIGS. 2*b* and 2*c* show the display after three days and eleven days, respectively, of the first part of the cycle, when an increasing number of grains of sand 6 have landed in the lower part of the hourglass.

FIG. 2*d* shows the display 5 one day before the end of the three-week part of the cycle, the last grain 6 in the hourglass has started to blink in order to announce that it is about time to perform an act.

FIG. 2*e* shows the display at the end of the three-week part of the cycle, and FIG. 2*f* shows that the next moment an audio signal, for example a beep, will be sounded by the signalling element 4, whereas an animation shows the ring "flying off" to indicate that the carrier containing the contraceptive must be removed. In addition to the continuous animation on the display, said warning signal is repeated every half hour for 24 hours so as to ensure that the user of the contraceptive is reminded of said removal at least once during said period. If desired, the warning signal can be turned off once the carrier containing the contraceptive has been removed.

FIG. 2*g* shows the display at the beginning of the one-week part of the cycle, wherein seven grains of sand 6 are shown to be present in the upper part of the hourglass. FIG. 2*h* shows display 5 during the last day of the one-week part of the cycle, wherein the last grain of sand 6 that is present in the upper part of the hourglass blinks to show that this part of the cycle is nearing is end. Present in the lower part of the hourglass are the six grains that represent the preceding six days of this part of the cycle.

FIG. 2*i* shows the display at the end of the cycle, wherein a (different) audio signal is sounded by the signalling element 4 and wherein an animation of an incoming ring indicates that a new carrier containing a contraceptive is to be inserted. The animation of FIGS. 2*i* and 2*j* can be started twelve hours before the start of a new cycle, for example, and be repeated every half hour. FIG. 2*k* corresponds to FIG. 2*a* and shows the display at the beginning of the new cycle.

FIGS. 3*a*-3*k* show the display in accordance with a second embodiment of the invention, wherein the display is not hourglass-shaped but has the form of a ring, wherein one half of the ring is used to represent the days of the two parts of the cycle, in a manner which is comparable to the embodiment of FIG. 2. In this case a different day symbol is used to represent the 7 days of "non-use", viz. a circle instead of a dot or a grain.

From the foregoing it will be apparent that the timer according to the invention can form a useful aid for persons following a medical regimen, for example an anti-conception regimen. The timer or a graphical display continuously provides an indication of the status of the regimen, both with regard to the time and with regard to the amount of the contraceptive. At the time of the alarm, animations clearly show which act is to be performed, so that the risk of errors is ruled out.

The invention is not restricted to the above-described embodiments as shown in the drawing, which can be varied in several ways without departing from the scope of the invention. Thus it is possible not to show the time status of the regimen, or only very globally, for example by means of blocks representing one week in the case of the special anti-conception regimen. This applies in particular with regard to the three-week part of the cycle. In principle, the invention can also be used with other regimens, such as menopause regimens, rheumatism regimens, or to remind a person to put in or take out his or her contact lenses and the like.

The invention claimed is:

1. An electronic alarm timer for use with a medical regimen in which at least a first act and a second act are to be performed at different times, the first act being different than the second act, said electronic alarm timer comprising a housing containing a control unit having a timer, indicating means on the housing, which are connected to the control unit in order to show information, and timed alarm means connected to the control unit, wherein said control unit and said indicating means include means to show information on the desired status of the medical regimen and about the different acts to be performed in graphical representation and wherein said control unit and said indicating means are adapted to show information in a graphical representation without written text alone, wherein said means to show information on the desired status of the medical regimen and about the different acts to be performed display a graphical representation of a first desired status of the medical regimen and a graphical representation of a second desired status of the medical regimen, the graphical representation of the first desired status of the medical regimen being different than the graphical representation of the second desired status of the medical regimen, and wherein said means to show information on the desired status of the medical regimen and about the different acts to be performed display a graphical representation of the first act and a graphical representation of the second act, the graphical representation of the first act being different than the graphical representation of the second act.

2. A timer according to claim 1 for use with a contraceptive regimen.

3. A timer according to claim 1 for use with an anti-conception regimen, wherein said indicating means graphically represent days of a cycle.

4. A timer according to claim 3 for use with an anti-conception regimen wherein a contraceptive must be present in or on a body during part of the cycle and the contraceptive must be removed for the duration of another part of the cycle, and wherein the indicating means graphically show the situation, whereas the alarm is adapted to sound at the time of the transition from one part of the cycle to another, whereby the removal or the application, as the case may be, of the contraceptive is indicted by means of an animation.

5. A timer according to claim 3, wherein said control unit and said indicating means are adapted to indicate the approaching transition from one part of the cycle to another for a certain period prior to said transition.

6. A timer according to claim 5, wherein said certain period is one day.

7. A timer according to claim 5, wherein said indicating means are adapted to show a particular day which is made to blink in the display.

8. A timer according to claim 3, wherein said indicating means show an hourglass, with the days of the cycle being represented as grains of sand.

9. A method for supporting a medical regimen in which at least a first act and a second act are to be performed at different times, the first act being different than the second act and wherein use is made of an electronic timer comprising indicating means and alarm means, comprising the steps of:

graphically showing on said indicating means a graphical representation of a first desired status of the medical regimen, graphically displaying on said indicating means a graphical representation of the first act while the alarm is activated to indicate that said first act is to be performed, graphically showing on said indicating means a graphical representation of a second desired status of the medical regimen, the graphical representation of the second desired status of the medical regimen being different than the graphical representation of the first desired status of the medical regimen, graphically displaying on said indicating means a graphical representation of the second act while the alarm is activated to indicate that said second act is to be performed, the graphical representation of the second act being different than the graphical representation of the first act, wherein said indicating means is adapted to show information in a graphical representation without written text alone.

10. An electronic alarm timer for use with an anti-conception regimen by means of a contraceptive to be inserted into or to be applied to the body, wherein the contraceptive must be present in or on the body during part of the cycle of the regimen, and wherein said contraceptive must be removed for the duration of another part of the cycle, comprising:

a housing containing a control unit having a timer, indicating means on the housing, which are connected to the control unit in order to show information, and timed alarm means connected to the control unit to provide sound at the times of transitions between said parts of the cycle, said control unit and said indicating means cooperating to graphically display information about a desired status of the medical regimen and to graphically display information about an act to be performed, so that removal or application of said contraceptive, as the case may be, is indicated by an animation at least during the time that said alarm means is activated wherein said graphical displays of information about the status of the medical regimen and about acts to be performed are shown in graphical representations without text alone.

11. An electronic alarm timer for use with a medical regimen in which at least two different acts are to be performed at different times, comprising:

a housing containing a control unit having a timer;

indicating means on the housing, which are connected to the control unit in order to show information; and timed alarm means connected to the control unit;

wherein said control unit and said indicating means include means to show information on the desired status of the medical regimen and about the different acts to be performed in graphical representation and wherein said control unit and said indicating means are adapted to show information in a graphical representation without written text alone;

wherein said control unit and said indicating means graphically display in a first manner, without written text alone, a first countdown for a first act be to be performed;

wherein said control unit, said indicating means and said timed alarm means present a graphical and audible alarm, in a first manner, when the first act is to be performed;

wherein said control unit and said indicating means graphically display, in a second manner distinctive from the first manner, without written text alone, a second countdown for a second act, different than the first act, to be performed;

wherein said control unit, said indicating means and said timed alarm means present a graphical and audible alarm, in a second manner distinctive from the first manner, when the second act is to be performed.

12. A timer according to claim 11 for use with a contraceptive regimen.

13. A timer according to claim 11 for use with an anti-conception regimen, wherein said indicating means graphically represent days of a cycle.

14. A timer according to claim 13 for use with an anti-conception regimen wherein a contraceptive must be present in or on a body during part of the cycle and the contraceptive must be removed for the duration of another part of the cycle, and wherein the indicating means graphically show the situation, whereas the alarm is adapted to sound at the time of the transition from one part of the cycle to another, whereby the removal or the application, as the case may be, of the contraceptive is indicted by means of an animation.

15. A timer according to claim 13, wherein said control unit and said indicating means are adapted to indicate the approaching transition from one part of the cycle to another for a certain period prior to said transition.

16. A timer according to claim 15, wherein said certain period is one day.

17. A timer according to claim 15, wherein said indicating means are adapted to show a particular day which is made to blink in the display.

18. A timer according to claim 13, wherein said indicating means show an hourglass, with the days of the cycle being represented as grains of sand.

19. A method for supporting a medical regimen in which at least two different acts are to be performed at different times, and wherein use is made of an electronic timer comprising indicating means and alarm means, comprising the steps of:

(a) graphically displaying in a first manner, without written text alone, a first countdown for a first act be to be performed;

(b) presenting an alarm and graphically displaying performance of the first act when the first act is to be performed to indicate that the first act is to be performed;

(c) graphically displaying, in a second manner distinctive from the first manner, without written text alone, a second countdown for a second act, different than the first act, be to be performed; and (d) presenting an alarm and graphically displaying performance of the second act when the second act is to be performed to indicate that the second act is to be performed.

20. The method for supporting a medical regimen according to claim 19, wherein steps (a)-(d) are repeated indefinitely.

* * * * *

UNITED STATES PATENT AND TRADEMARK OFFICE

CERTIFICATE OF CORRECTION

PATENT NO. : 7,369,463 B1
APPLICATION NO. : 10/203196
DATED : May 6, 2008
INVENTOR(S) : Marlies Van Dullemen et al.

It is certified that error appears in the above-identified patent and that said Letters Patent is hereby corrected as shown below:

On the title page, item [22] should read

-- (22) PCT Filed: February 19, 2001. --

Signed and Sealed this

Third Day of February, 2009

JOHN DOLL
*Acting Director of the United States Patent and Trademark Office*